US006562229B1

(12) United States Patent
Burgher et al.

(10) Patent No.: US 6,562,229 B1
(45) Date of Patent: May 13, 2003

(54) LOUVERED ANODE FOR CATHODIC PROTECTION SYSTEMS

(76) Inventors: John W. Burgher, 1108 Palmerston Crescent, Kingston, Ontario (CA), K7P 2P5; Dennis F. Dong, 12 Nottingham Place, Kingston, Ontario (CA), K7M 7H1; Richard E. Loftfield, 1050 Secret Oaks Pl., Fruitcove, FL (US) 32259

( * ) Notice: Subject to any disclaimer, the term of this patent is extended or adjusted under 35 U.S.C. 154(b) by 811 days.

(21) Appl. No.: 08/854,332

(22) Filed: May 12, 1997

(51) Int. Cl.[7] ..... C23F 13/00

(52) U.S. Cl. ..... 205/724; 204/196.01; 204/196.1; 204/196.21; 204/196.36; 204/290.14; 204/292; 204/284; 205/730; 205/734; 205/738

(58) Field of Search ..... 204/196, 197, 204/284; 205/724, 730–734, 738

(56) References Cited

U.S. PATENT DOCUMENTS

| | | | | |
|---|---|---|---|---|
| 3,279,043 A | 10/1966 | Wirt | ..... | 29/163.5 |
| 3,376,684 A | 4/1968 | Cole et al. | ..... | 52/635 |
| 3,929,607 A | 12/1975 | Krause | ..... | 204/286 |
| 4,401,530 A | 8/1983 | Clere | ..... | 204/98 |
| 5,031,290 A | 7/1991 | Brereton et al. | ..... | 29/6.1 |
| 5,062,934 A | 11/1991 | Mussinellil | ..... | 204/147 |
| 5,421,968 A | 6/1995 | Bennett et al. | ..... | 204/147 |

FOREIGN PATENT DOCUMENTS

| | | | | |
|---|---|---|---|---|
| CA | 2078616 | 3/1993 | ..... | C23G/13/10 |
| CA | 1325789 | 1/1994 | ..... | C23S/13/02 |

OTHER PUBLICATIONS

*Metals Handbook*, 9th ed., (1981), pp. 763–764.*

* cited by examiner

*Primary Examiner*—T. Tung
(74) *Attorney, Agent, or Firm*—Hudak, Shunk & Farine Co. LPA

(57) ABSTRACT

A metal anode useful in a galvanic or impressed current cathodic protection system for a steel reinforced concrete article is a unitary, multi-plane, porous, metal anode strip or ribbon having a plurality of louvers defining a plane or planes at the lateral extremities of said louvers. In one embodiment, louvers extending in their long dimension longitudinally on the anode strip are spaced apart from adjacent louver units by an intermediate plane. Louvered anode strips consisting of a valve metal or alloy or mixture thereof are useful at an anode current density of up to about 20 milliamps per square foot. Louvered metal anodes comprising an electrocatalytically active coating on a valve metal substrate are useful at higher anode current densities. Sacrificial metal anodes such as zinc anodes are useful in galvanic cathodic protection systems.

20 Claims, 2 Drawing Sheets

LOUVERED ANODE FOR CATHODIC PROTECTION SYSTEMS

TECHNICAL FIELD

This invention is directed to anodes for use in cathodic protection systems.

BACKGROUND ART

Cathodic protection of metal structures, or of metal containing structures, in order to inhibit or prevent corrosion of the metal in the structure is well known by use of galvanic or impressed current cathodic protection systems. In impressed current systems, counter electrodes and the metal of the structure are connected to a source of direct current. In operation, the metal of the structure, such as a steel reinforcement for a concrete structure, is cathodically polarized. The steel reinforcement being spaced apart from the anodically polarized electrode becomes cathodically polarized and is inhibited against corrosion. Cathodic protection is well known for metal or metal containing structures such as in the protection of offshore steel drilling platforms, oil wells, fuel pipes submerged beneath the sea, and in the protection of the hulls of ship. A particularly difficult problem is presented by the corrosion of steel reinforcement bars in steel reinforced concrete structures. Most portland cement concrete is porous and allows the passage of oxygen and aqueous electrolytes. Salt solutions, which remain in the concrete as a consequence of the use of calcium chloride to lower the freezing point of uncured concrete or snow or ice melting salt solutions which penetrate the concrete structure from the environment, can accelerate the corrosion of steel reinforcing elements in the concrete. For example, concrete structures which are exposed to ocean water and concrete structures in bridges, parking garages, and roadways which are exposed to water containing salt used for deicing purposes are rapidly weakened as the steel reinforcing elements corrode. This is because such elements when corroded create local pressure on the surrounding concrete structure which brings about cracking and eventual spalling of the concrete.

Known methods of introducing an anode within an existing concrete structure may involve insertion of an anode into a slot cut into the concrete. After application of the anode a cap of grout is applied to backfill the slot. Representative anodes for cathodic protection of steel reinforced concrete structures are disclosed in U.S. Pat. No. 5,062,934 to Mussinelli in which a grid electrode comprised of a plurality of valve metal strips having voids are disclosed. Another type of anode strip for cathodic protection of steel reinforced concrete structures is disclosed in Canadian 2,078,616 to Bushman in which mesh anodes are disclosed consisting of an electrocatalytically coated valve metal which is embedded in a reinforced concrete structure so as to function as the anode in a cathodic protection system. In U.S. Pat. No. 5,031,290 a process is disclosed for the production of an open metal mesh having a coating of an electrocatalytically active material formed by slitting a sheet and stretching the coated sheet to expand the sheet and form an open mesh. In U.S. Pat. No. 4,401,530 to Clere, a three dimensional electrode having substantially coplanar portions, substantially flat portions, and ribbon-like curved portions is disclosed for use as a dimensionally stable anode in the production of chlorine and caustic soda. The ribbon-like portions of the anode are symmetrical and alternate in rows above and below the flat portions of the anode.

In U.S. Pat. No. 3,929,607 to Krause, an anode assembly for an electrolytic cell is disclosed comprising a film-forming metal foraminate structure comprising a plurality of longitudinal members spaced with their longitudinal axis parallel to one another and carrying on at least part of their surface an electrocatalytically active coating. Each longitudinal member comprises a channel blade member constituted by a pair of parallel blades having one or more bridge portions connected to the current lead-in means.

In Canadian 1,325,789 to Martin et al., a cathodic protection system for steel reinforced concrete is disclosed in which a valve metal anode is used. An anode having an electrochemically active surface coating is used. The coating can be an oxide selected from the group consisting of platinum group metal oxides, magnetite, ferrite, and cobalt oxide spinel.

A permeable metal structure useful for acoustical and other special purposes is disclosed in U.S. Pat. No. 3,279,043. The structure is prepared by perforating a metal sheet and bending portions of the metal in a plurality of locations so as to produce what can be characterized as a double corrugated sheet metal. Similarly, in U.S. Pat. No. 3,376,684 a double corrugated sheet is produced from flat sheet metal stock by slitting a metal sheet and bending portions of the sheet so as to provide curved portions above and below the plane of the flat sheet metal stock.

The novel anodes of the invention in comparison with prior art mesh anodes for cathodic protection of steel reinforced concrete provide less resistance to flow of concrete and concrete grout and improved electrical current flow characteristics.

DISCLOSURE OF THE INVENTION

Unitary, multi-plane, porous, anodes in strip form are disclosed which are useful, for instance, deposited within a steel reinforced concrete article as part of a cathodic protection system. Anodes comprising a valve metal, valve metal alloy, or mixtures of valve metals are preferred for use in impressed current cathodic protection systems. For galvanic cathodic protection systems, the metal most often comprises zinc although other sacrificial metals having a higher electropotential than the reinforcing metal of the concrete structure can be used. The following discussion will be restricted to anodes comprising a valve metal for use in an impressed current cathodic protection system. Generally, the anodes of the invention are deposited within a horizontal, inclined, vertical, or overhead surface of said steel reinforced concrete article.

The metal strip anodes of the invention are characterized by a plurality of louvers formed on a first plane of a valve metal strip having the largest area, said louvers defining a second plane or both a second plane and a third plane at the lateral extremities of said louvers. Multiple louver units can be longitudinally spaced apart from adjacent units thus forming a series of multiple louver units. Each unit can be formed of louvers having the same or individually selected angles. Generally, louvers are formed having angles in their long dimension with the longitudinal direction of the metal strip of about 0° to about 90° and, preferably, 20° to about 90°, and, most preferably, about 70° to about 90°. The louvers form angles with the largest area plane of the metal strip of about 20° to about 90°, preferably, about 70° to about 90°.

The metal strip anodes of the invention bear a plurality of louvers oriented in the long dimension of the louver along the longitudinal or lateral dimension of the metal anode strip. These louvers, preferably, are substantially parallel or substantially perpendicular to the longitudinal dimension of the metal anode strip although, generally, any other orientation of the long direction of the louvers between 0° and 90° to the longitudinal dimension of the metal anode strip is useful. In addition, when the louvers are oriented in their long dimension along the longitudinal dimension of the metal anode strip, each successive group of louvers, as shown in FIG. 3, can be oriented at any individually selected angle of 0° to 90° to the longitudinal dimension of the metal anode strip. The louvers define upper and/or lower planes at the extremities of said louvers. Said louvers when oriented parallel to the longitudinal dimension of said strip are bordered at their longitudinal extremities by a plane intermediate between said upper and lower planes. The anode is, generally, formed either on an uncoated valve metal or on a valve metal coated with an electrocatalytically active metal. Said valve metal is selected from the group consisting of titanium, tantalum, zirconium, niobium, and alloys and mixtures thereof. Titanium is the preferred valve metal for forming the anodes of the invention. Where the valve metal is coated with an electrocatalytically active layer, generally, the coating comprises the oxide of a metal selected from the group consisting of a platinum group metal, cobalt, tin, and nickel. It is preferred that the coating comprise a platinum group metal oxide. Where the valve metal anode is uncoated, the usefulness of the anode is limited to cathodic protection systems having anode current densities of up to about 215 milliamps per square meter.

MODES FOR CARRYING OUT THE INVENTION

The present invention is a novel, unitary, multi-plane, porous, metal anode strip comprising in a first embodiment a plurality of louvers arranged in multiple louver units and, generally, aligned in their long dimension along the longitudinal or lateral direction of a metal strip from which the anode is formed at an angle of 0° to 90° to said longitudinal direction. The louvers form angles with the largest area plane of the metal strip of about 20° to about 90° and define upper and/or lower planes at the lateral extremities of said louver units. The louver units are longitudinally spaced apart from adjacent louver units by an intermediate plane extending between the upper and/or lower planes defined by the lateral extremities of the louvers.

In a second embodiment a plurality of louvers are, generally, aligned in their long dimension along the lateral direction of a metal strip from which the anode is formed. The louvers form angles with the largest area plane of the metal strip of about 20° to about 90° and define upper and/or lower planes at the lateral extremities of said louvers. An intermediate plane extending between the upper and lower planes defined by the lateral extremities of the louvers is formed at the longitudinal border of the louvers.

In other embodiments not shown in the Figures of the drawings, the louvers can be aligned in their long dimension at any angle between 0° to 90° to the longitudinal direction of the metal strip. This angle can be individually selected for units of louvers or this angle can be selected individually for each louver.

While each of the above embodiments are useful, it is preferred to utilize the embodiment first described above in which electrical conductivity along the anode strip will not be reduced or reduced very little in comparison with a metal strip without louvers.

The openings formed by the louvers of the anodes of the invention should be large enough to allow a concrete grout to flow through such openings. Generally, a minimum opening formed by the louvers is about 1.6 mm in dimension, preferably, about 2.4 mm to about 3 mm. On the other hand, the lateral dimensions of the louvers should not be so large that when they are formed by twisting the louver slats out of the largest plane of the starting strip of metal, that they do not form at their lateral extremities a plane or planes which extend from the largest plane of the starting metal strip so as to be inadequately covered in use by the concrete overlay. Preferably, the anode profile when viewed from the side should be less than about 13 mm.

Figure 1:
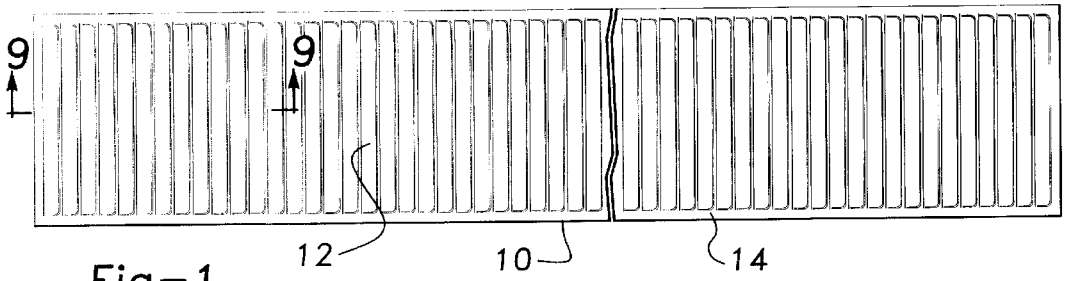
FIG. 1 is a plan view of a first embodiment of a unitary, multi-plane, porous, metal anode strip or ribbon of the invention showing a portion of the metal anode strip with a plurality of louvers arranged substantially laterally across the metal strip. The louvers can extend above or below or both above and below the plane of the metal strip.

The length of the louvers of the anode is less critical than the lateral dimensions set forth above. Generally, the length of the louvers can be about 13 mm to more than 7.6 cm or 10 cm in the first embodiment. In the first embodiment and other embodiments described above, the length of the louvers is, generally, greater than the width of the anode strip. In each of the embodiments, the louver anodes of the invention can be formed in units of louvers spaced apart from adjacent louver units. In the second embodiment described above, the louvers can also be arranged in a continuous series of louvers, as shown in FIG. 1 of the drawings. Giving due consideration to the width and thickness of a particular louver, the length of the louver in the first embodiment should not be so great that the rigidity of the anode is compromised, that is, not so great that the anode would not retain the original orientation under normal handling or installation procedures. In addition, the length of the louver if oriented in its long direction substantially parallel to the length of the starting anode strip, as in the embodiment shown in FIG. 3, should not be so great that should it be desired to roll up the louvered anode, an inordinately large diameter roll would result. Most preferred dimensions of the anode of the first embodiment are a 2 cm wide anode strip, 0.5 mm thick having louvers about 25.4 mm to about 3.8 cm long and about 2.4 mm to about 3.2 mm wide.

The louvers are formed after slitting the anode strip by twisting the louvers into their final orientation so as to form an angle with the plane of the anode strip from which the louvered anode is formed. Preferably, this angle is about 20° to about 90° to the largest plane of the original anode strip, most preferably, about 70° to about 90° to said plane. The louvers can be formed so that adjacent louver units are turned so as to alternate in direction. In addition, each louver can be formed so as to have individually selected angles with the largest plane of the anode strip.

The louvers can define upper and/or lower planes at the lateral extremities of said louvers. Intermediate between the upper and lower planes is the original base plane of the anode strip. The base or intermediate plane separating a series of louver units and/or bordering the louvers can vary in both lateral and longitudinal dimensions. In order to allow the anode to easily accommodate, during placement, the penetration of concrete grout, the length of the intermediate plane separating longitudinally oriented louver units, generally, is not more than 5 cm, preferably, less than 2.54 cm and, most preferably, about 9.5 mm to about 6.4 mm in longitudinal dimension. The intermediate plane bordering the laterally oriented louvers is, preferably, about 2.4 mm to about 3.2 mm.

The metal anodes of the invention for use in an impressed current cathodic protection system, generally, can be formed from an uncoated valve metal or can be formed from a valve metal coated with an electrocatalytically active metal coating. Where the anode of the invention is formed from an uncoated valve metal, the use of the anode in a cathodic protection system for reinforced steel elements in concrete is limited to those applications where the anode current density is controlled at up to about 215 milliamps per square meter unless the valve metal anode is activated by heating at an elevated temperature. Activation can be accomplished in accordance with copending, commonly assigned U.S. patent application, Ser. No. 08/502,249 filed Jul. 13, 1995, by heating the valve metal anodes exposed to air or an oxygen containing atmosphere. Generally, activation is accomplished by exposure of the uncoated valve metal to a temperature of about 250° C. to about 750° C., preferably, about 350° C. to about 750° C. for a period of about 3 minutes to about 5 hours. Upon activation, a substantial improvement in the lifetime of the anode occurs, as indicated by the time for passivation of the anode to occur at a given anode current density such as during use in a cathodic protection system. Useful valve metals are selected from the group consisting of titanium, tantalum, zirconium, niobium, and alloys and mixtures thereof. Useful electrocatalytically active metal coatings are, generally, the oxides of platinum group metals, cobalt, nickel, and tin.

In accordance with copending, commonly assigned U.S. patent applications, Ser. No. 08/502,248, Ser. No. 08/502,249, each filed Jul. 13, 1995, and Ser. No. 08/593,507, filed Jan. 30, 1996, uncoated valve metal anodes can be used in electrochemical systems operating at low current density. Anode current densities of up to about 215 milliamps per square meter can be used with the uncoated valve metal anode of the invention without an electrocatalytically active metal coating. Preferably, cathodic protection systems in which steel reinforcing elements are embedded in concrete are operated at an anode current density of about 108 to about 215 milliamps per square meter, most preferably, an anode current density of about 22 to about 54 milliamps per square meter. Upon heat activation of the valve metal anode, anode current densities of up to about 550 milliamps per square meter can be used, preferably, about 215 to about 430 milliamps per square meter. Where the novel anode of the invention is utilized with a valve metal base and an electrocatalytically active metal coating thereon, cathodic protection systems can be operated at substantially higher anode current densities such as about 860 to about 1290 amps per square meter.

The application of an electrocatalytically active metal coating on the surface of a valve metal substrate can be accomplished by dip coating, painting, or spraying an aqueous or organic solvent solution of a soluble precursor compound on the surface of the valve metal. Application of the precursor catalyst compound can also be made by electrolytic and electroless plating and by thermal spraying. Thermal spraying is defined to include arc-spraying as well as plasma and flame spraying. Subsequent to application of a precursor compound, the coating can be anodically oxidized or heated to convert the precursor compound to an electrocatalytically active metal compound such as the oxide. Thermally sprayed precursor compound coatings may not require heating to convert the coating to the electrocatalytically active metal compound.

Preferred catalyst precursor compounds are platinum group metal compounds selected from the group consisting of compounds of platinum, palladium, ruthenium, rhodium, osmium, iridium, or mixtures or alloys thereof. Cobalt, nickel, and tin precursor compounds can also be utilized in the formation of electrocatalytically active metal coatings. Heating these precursor compounds to form the oxides is required to convert the precursor compounds to catalysts.

The three-dimensional structure of the anode of the invention results in the distribution of the electrical current in multiple planes within the concrete. Because both the anode structure and the electrical current distribution are not concentrated in one plane, there is, less likelihood of subsequent delamination of the concrete overlay as a result of the anode installation. If the structure is all or substantially all in one plane, such as illustrated by the prior art mesh or expanded metal mesh anodes, for instance, there is a greater tendency for a concrete overlay covering the anode to separate from the underlying concrete.

The efficiency of the distribution of current from the surface of the anode to the steel rebar reinforcement is directly proportional to the proximity of the anode surface to the rebar. If the anode is placed between two mats of steel rebar, the current will emanate, for instance, from both sides of the anode louver and from the intermediate planes either separating longitudinally adjacent louver units in one embodiment of the anode of the invention or the intermediate plane bordering the laterally oriented louvers of another embodiment of the invention. The amount of current emanating from the louvers of the anode of the invention tends to be greater than the amount of current emanating from the intermediate plane areas of the anode. This is quite different from the current distribution obtained with the mesh anodes of the prior art in which the current from the essentially flat plane of the mesh structure emanates equally from the crossing and connecting strands; that is, the current tends to be evenly distributed.

The anodes of the invention can be placed in slots within a horizontal, inclined, vertical, or overhead surface of a steel reinforced concrete structure. For vertical orientation, it is desirable that the slots in the concrete be relatively deep and narrow, and that the largest plane of the anode be substantially perpendicular to the overall surface of the concrete. For horizontal orientation in slots, the largest plane of the anode can be substantially parallel to the overall surface of the concrete. The anodes are, preferably, embedded in a conductive material after placement. For placement in horizontal or vertical slots, a conductive grout is used. For placement of the anodes on the surface of a concrete structure, the anodes are embedded in a conductive overlay. The anodes of the invention maintain their structure during placement on or within a concrete structure, that is, the upper and/or lower planes, defined at the lateral extremities of the louvers, remain distinct from the intermediate plane from which the louvers are formed.

The anodes are produced by first perforating a metal strip by shearing preselected portions thereof in uniform and closely spaced relation of one to another so as to form exposed edges and portions of strips. Subsequently, the metal rows between perforations are twisted so as to form louvers which are turned on edge to an angle of, generally, about 20° to about 90°, preferably, about 70° to 90° to the largest area plane of the metal strip from which the anode of the invention is formed. The anode of the invention can be formed using conventional metal working equipment such as a piercing die to perforate preselected portions of the metal strip and a die mechanism to impart the final shape to the louvers. In certain instances, the piercing and shape forming operations can be completed with the same dies.

Referring now to the drawings, in FIG. 1 there is shown one embodiment of the anode of the invention in a plan view. A sheet stock valve metal strip 10 is slit laterally and longitudinally to form a wide "U" slit so as to define louvers 12 which are formed by twisting the slit sheet stock so as to form louvers which are inclined at an angle, generally, of about 20° to about 90° to the largest area plane of the sheet stock valve metal strip. Bordering the longitudinal extremities of said louvers is base plane 14 which is intermediate between the planes defined by the lateral extremities of louvers 12 which upon twisting can extend either above or both above and below the intermediate, original plane of the sheet stock valve metal strip.

Figure 2:
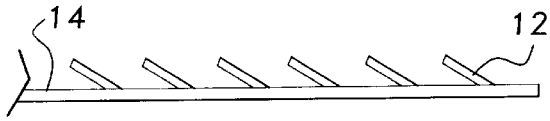
FIG. 2 is a side view of one embodiment of the anode of FIG. 1 showing louvers extending above the plane of the metal strip.
Figure 7:
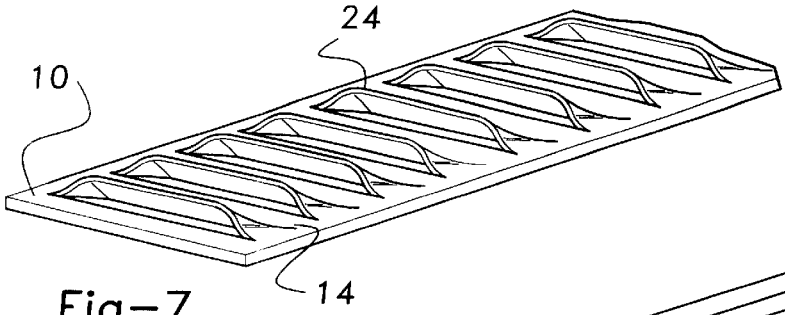
FIG. 7 is an alternative isometric view of the anode of FIG. 1 in which the louvers extend both above and below the plane of the metal strip.
Figure 9:
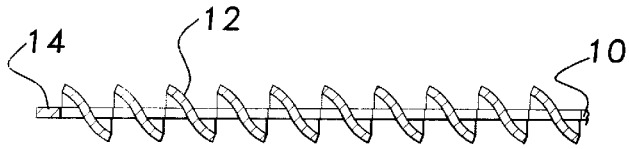
FIG. 9 is a cross sectional view of the anode of FIG. 1 showing another embodiment in which the louvers extend both above and below the plane of the metal strip.

In FIG. 2 there is shown in an enlarged side view one embodiment of the anode of the invention shown in a plan view in FIG. 1. The louvers 12 are shown in FIG. 2 extending above base plane 14 but the louvers of FIG. 1 can also extend in another embodiment of the anode of the invention both above and below the plane of the sheet stock, as shown in FIG. 7 and in the side view through section 9—9 of FIG. 1 as shown in FIG. 9. In addition, the louvers can be twisted so as to regularly alternate or randomly alternate above and below the intermediate, original plane 14.

Figure 3:
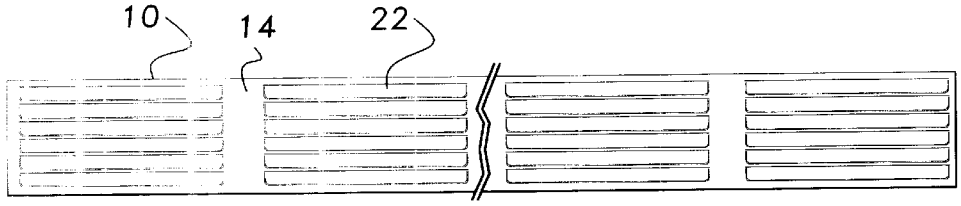
FIG. 3 is a plan view of a second embodiment of a unitary, multi-plane, porous, metal anode of the invention showing a portion of the metal strip anode with series of louver units longitudinally oriented on the metal strip in the long dimension of the louvers in a direction substantially parallel to the longitudinal direction of the metal strip. The louvers can extend above or below or both above and below a largest area plane of the metal strip. In this embodiment, the louver units are spaced apart from adjacent louver units.

In FIG. 3, there is shown in a plan view an embodiment of the invention in which a sheet stock valve metal strip 10 is slit longitudinally and laterally to form a wide "U" slit so as to allow louvers 22 to be formed by twisting sections defined by adjacent slits in the flat sheet stock material. The louvers are made by twisting the slit sheet stock to form a series of louver units oriented at an angle, generally, of about 20° to about 90° to the largest area plane of the sheet stock material. The louvers can define at their lateral extremities either upper or both upper and lower planes when they extend both above and below the intermediate, original plane 14 which separates successive louver units.

Figure 4:
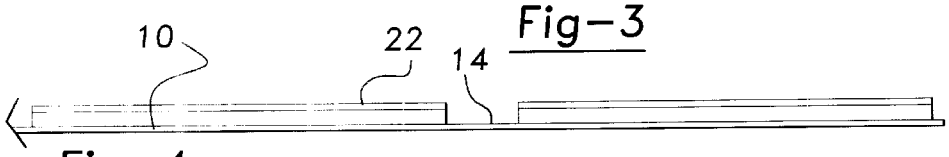
FIG. 4 is a side view of the anode of FIG. 3 showing louvers extending above the plane of the metal strip.
Figure 8:
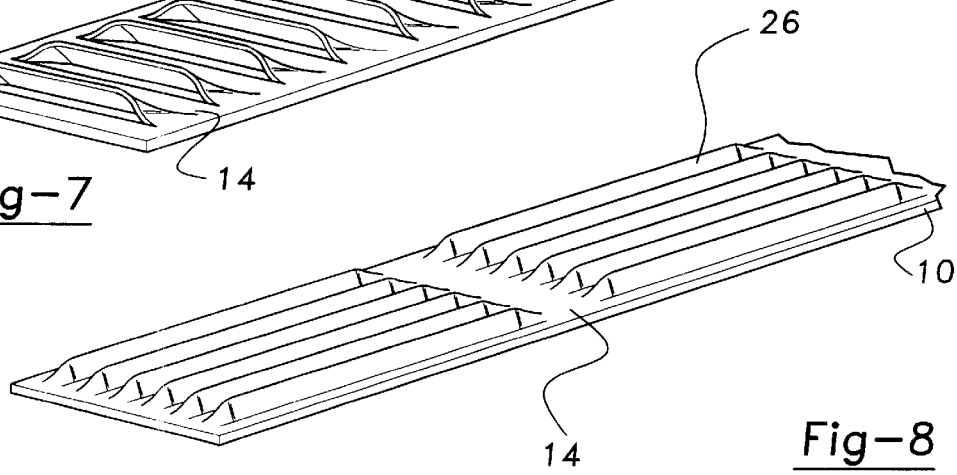
FIG. 8 is an alternative isometric view of the anode of FIG. 3 in which the louvers extend both above and below the plane of the metal strip.

FIG. 4 shows in an enlarged side view the embodiment shown in FIG. 3 in which louvers formed from sheet stock valve metal strip 10 extend above original plane 14. In FIG. 8, the louvers 22 extend both above and below original plane 14 which is now intermediate between the planes formed by the lateral extensions of the louvers. It is noted that in each of the embodiments of FIGS. 1–8 the louvers are formed from sheet stock valve metal strip without substantially contracting or stretching the material either longitudinally or laterally. Thus, both longitudinal and lateral dimensions of the sheet stock valve metal strip remain essentially unchanged during formation of the anode.

Figure 5:
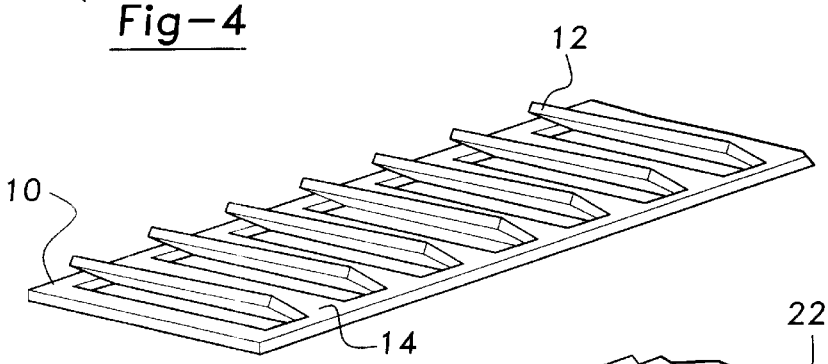
FIG. 5 is an isometric view of the anode of FIG. 1.
Figure 6:
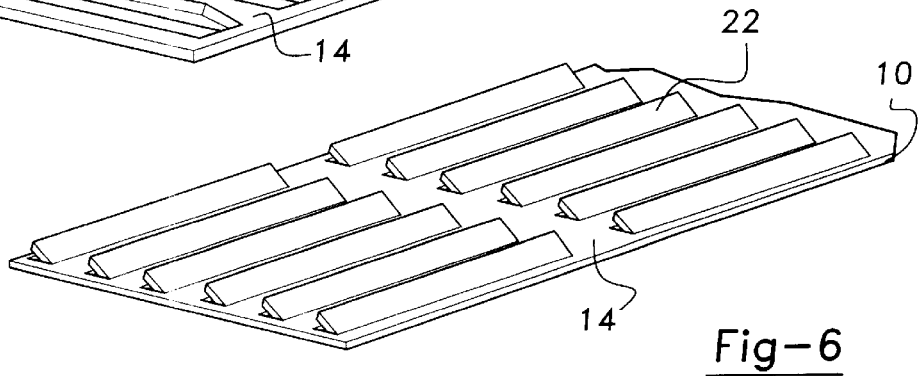
FIG. 6 is an isometric view of the anode of FIG. 3.

FIGS. 5 and 6 are isometric views of the embodiments shown in FIGS. 2 and 3 in which the slits in the sheet stock form the shape of a wide "U". As shown in FIGS. 5 and 6, the louvers 12 or 22 project on only one side of plane 14 of sheet stock 10.

FIGS. 7 and 8 are respective alternative isometric views of the embodiments shown in plan view in FIGS. 1 and 3. In FIGS. 7 and 8, the slits cut in the metal sheet stock 10 are formed by making straight cuts rather than cuts which take the form of a wide letter "U". On twisting the metal between the slits, louvers 24 or 26 are obtained. The louvers can also project both above and below original plane 14 of metal sheet 10, as more clearly shown in FIG. 9 which is an enlarged cross sectional view through section 9—9 of FIG. 1 in which metal sheet stock 10, original plane 14, and louver 12 are shown.

The following Examples illustrate the present invention but should not be construed, by implication or otherwise, as limiting the scope of the appended claims. Where not otherwise specified in the specification and claims, temperatures are in degrees centigrade and parts, percentages, and proportions are by weight.

EXAMPLE 1

An anode of one embodiment of the invention, substantially as shown in FIG. 3, is prepared by slitting a grade I titanium strip having a thickness of 0.5 mm and a width of 19 mm. Slits are made in the longitudinal direction of the strip measuring 64 mm in length forming a series of 8 slits extending across the width of the titanium tape. Louvers are formed having dimensions 0.5 mm in thickness, 64 mm in length, and 2.4 mm in width. The louvers are turned at an angle to the plane of the original titanium tape by twisting the metal between the slits so as to form groups of louvers having an angle of about 60° to about 80° to the plane of the original titanium strip. The uncut portion extending longitudinally between the groups of louvers is approximately 32 mm in length. The height of that portion of each louver which extends both above and below the original plane of the titanium tape is approximately 1.12 mm. Each group of louvers is twisted in a direction opposite to the adjacent group to provide groups of louvers having an alternating twist. The profile height of the louver tape anode is 2.24 mm.

EXAMPLE 2

Control, Forming No Part of This Invention

Using a grade I titanium strip measuring 19 mm by 0.5 mm, a series of slits are made in the longitudinal direction having a length of 9.5 cm. The width between slitted portions of the titanium strip is about 2.38 mm. The number of slits and the dimensions are the same as described in Example 1 but no louvers are formed by twisting the metal between the slits.

EXAMPLE 3

Control, Forming No Part of This Invention

A grade I titanium ribbon having a width of 19 mm and a thickness of 0.5 mm without slits.

EXAMPLE 4

Control, Forming No Part of This Invention

A grade I titanium strip having a width of 19 mm and a thickness of 0.5 mm is expanded to form a diamond shaped mesh in accordance with the teachings of the prior art. The expanded mesh has a width of 64 mm, a mesh thickness of 3.2 mm, a mesh strand width of 2.4 mm, a diamond long way dimension of 64 mm, and a diamond short way dimension of 15.9 mm.

EXAMPLE 5

The anodes of Examples 1–4 are evaluated for voltage drop (IR drop) over a 45.7 cm length of each strip and the anodes described in Examples 1–4. The voltage drop is measured both at a current at 1 ampere and at a current of 2 amperes. The results shown in the Table below clearly illustrate the advantageous performance of the anode of Example 1 in comparison with the mesh anode control Example 4.

TABLE

| | Voltage (IR) drop (millivolts) | | | |
|---|---|---|---|---|
| Current (amperes) | EXAMPLE 1 | EXAMPLE 2 | EXAMPLE 3 | EXAMPLE 4 |
| 1 | 21.8 | 22.7 | 21.2 | 23.4 |
| 2 | 43.6 | 45.6 | 42.5 | 46.7 |

EXAMPLE 6

In order to evaluate the anodes described herein as to the ease with which a concrete grout will flow around and below the louvers of the anode, the anodes prepared in Example 1 are embedded in a concrete grout. The anodes and grout are placed on a 6.4 mm thick plate of glass so that the effect of any blockage of the flow of grout can be made visible from below. To simulate the application of the anode into 2.54 cm slots cut into a reinforced concrete surface, suitable long rectangular polypropylene bars are placed on the plate of glass spaced 2.54 cm from each other. Thereafter, three anodes are placed on the glass at the bottom of the slots formed by the rectangular bars previously described. The anodes utilized are those prepared in Examples 1–3.

Thereafter, a concrete grout is prepared by thoroughly mixing 1 kilogram of portland cement, type I with 0.4 kilograms of water and 2.0 kilograms of sand. The concrete is poured into the slots containing the anodes and packed and troweled. The final top surface is smoothed with a spatula. After the concrete has hardened, the apparatus is turned over and the areas underneath the samples are inspected through the plate of glass. The results are as follows:

Using the titanium tape anode prepared in Example 1 results in the area between the glass plate and the anode being filled approximately 98 to 99 percent with concrete. The concrete looks uniformly packed and the louvers are well encased in the concrete. Two small areas without concrete are in the form of bubbles measuring about 1.6 mm in diameter.

Using the anode prepared in Example 2 results in about 80 percent of the area of the anode being encased in concrete. The 20 percent of the area without concrete encasement is composed of oblong spaces, the largest being about 12.7 mm by 6.4 mm.

The anode prepared in Example 3 shows about 75 percent of the area of the anode encased with concrete. Most of the areas containing concrete have only a thin, non-uniform layer. The 25 percent of the area without concrete is composed of large, oblong spaces, the largest being about 19 mm by 6.4 mm.

EXAMPLE 7

A concrete slab is fabricated having dimensions of 35.6 cm by 17.9 cm by 5 cm. Sodium chloride is added to the wet concrete mix in order to simulate the conditions found in the preparation of typical reinforced concrete or structures exposed to salt containing environments as a result of the use of salt during winter months on roadways and bridges. A concentration of about 2.3 kilograms of sodium chloride per cubic meter of concrete is used. Embedded in the concrete slab is a steel bar simulating a reinforcing steel bar typical in many concrete bridge structures. The steel bar protrudes at one end of the concrete slab in order to allow connection to an electrical circuit.

The anode of Example 1 is placed in a slot cut in the surface of the concrete slab and thereafter back filled with concrete grout. The concrete block is placed in an atmosphere having 90–100 percent relative humidity. The titanium anode is connected to a positive post and the reinforcing steel bar is connected to a negative post of a regulated power supply. The power supply for the circuit is adjusted to give a constant current of 1.16 milliamps which is calculated to be equivalent to a current density on the surface of the titanium anode of 21.5 milliamps per square meter. Comparison of the initial cell voltage which is measured between the titanium anode and the steel bar and the cell voltage after 31 days of operation indicates that no passivation of the titanium anode occurs.

EXAMPLE 8

Three titanium anodes prepared in accordance with the procedure of Example 1 are placed in separate electrolytic cells, each containing a solution of sodium hydroxide at 0.85 molar concentration. The surface areas of the anodes are sized so that the anode current densities in an electrical circuit are 8.6, 21.5, and 54 amperes per square meter. These anodes are placed in series in the electrical circuit. Three steel sheets are used as cathodes. After energizing the electrical circuit, the initial voltages on start-up of the 3 cells so formed are recorded as well as the times for a cell voltage increase of 6 volts. It is believed that the time for the cells to show a voltage increase of 6 volts is proportional to the expected useful lifetime of a titanium anode (time to passivation) when connected to an electrical circuit in a cathodic protection system.

EXAMPLE 9

Two samples of the titanium anode of Example 1 are heated in air to a temperature of 550° C. for a period of thirty minutes and then utilized in the test procedure of Example 8. Anode current densities of 54 amps per square meter and 108 amps per square meter are placed upon these samples of titanium anodes in the electrolytic cell described in Example 8. Comparison of the time in seconds for a 6 volt cell voltage increase at each of these current densities indicates that the heated anodes of Example 9 take a substantially longer time before passivation occurs, as indicated by a 6 volt cell voltage increase, than the anodes of Example 8.

EXAMPLE 10

Three samples of the titanium anode of Example 1 are heated in air to a temperature of 350° C. for a period of thirty minutes and then evaluated in the electrolytic cells described in Example 8 at anode current densities of 21.5, 54, and 108 amps per square meter. Comparison of the anodes of Examples 8 and 9 with those of Example 10 indicates that the anodes of Example 10 take a substantially longer time before passivation occurs, as indicated by a 6 volt cell voltage increase.

While this invention has been described with reference to certain specific embodiments, it will be recognized by those skilled in the art that many variations are possible without departing from the scope and spirit of the invention, and it will be understood that it is intended to cover all changes and modifications of the invention disclosed herein for the purposes of illustration which do not constitute departures from the spirit and scope of the invention.

What is claimed is:

1. In a galvanic or impressed current cathodic protection system comprising a plurality of porous, metal anodes, the improvement wherein each of said anodes comprises a unitary, porous, metal strip comprising a plurality of louvers formed on a first plane of said metal strip having a largest area, said louvers having a lateral and a long dimension, and said louvers defining a second plane or both a second plane and a third plane at the lateral extremities of said louvers.

2. The cathodic protection system of claim 1 wherein said cathodic protection system comprises said steel reinforced concrete article wherein each of said metal anodes comprises a valve metal strip or a sacrificial metal strip and said louvers are oriented in their long dimension at an angle of 0° to 90° to the longitudinal dimension of said metal strip.

3. The cathodic protection system of claim 2 wherein said metal strip comprises zinc or a valve metal, said louvers form an angle to said first plane of said metal strip greater than 0 degrees up to 90°, and said metal strip is deposited within said steel reinforced concrete article.

4. The cathodic protection system of claim 3 wherein said metal strip comprises louvers oriented in their long dimension substantially parallel or substantially perpendicular to the longitudinal direction of said metal strip and said metal strip is deposited within a horizontal, inclined, vertical, or overhead surface of said steel reinforced concrete article.

5. The cathodic protection system of claim 4 wherein said metal strip is selected from metals of the group consisting of zinc or alloy thereof, a valve metal or alloy or mixture thereof, and an electrocatalytically active metal coated valve metal or alloy or mixture thereof, and each of said anodes comprises louvers forming an angle to said first plane of said valve metal strip of about 20° to about 90°.

6. The cathodic protection system of claim 5 wherein each of said metal anodes comprises louvers oriented in their long dimension substantially parallel to the longitudinal dimension of said strip.

7. The cathodic protection system of claim 6 wherein said metal strip consists of zinc or a valve metal.

8. The cathodic protection system of claim 6 wherein said metal strip consists of an electrocatalytically active metal coated valve metal or alloy or mixture thereof and said valve metal is selected from the group consisting of titanium, tantalum, zirconium, and niobium.

9. The cathodic protection system of claim 8 wherein said metal strip consists of an electrocatalytically active metal coated titanium or an electrocatalytically active metal coated valve metal alloy selected from the group consisting of titanium-palladium, titanium-ruthenium, titanium-iron, and titanium-copper and said cathodic protection system is operated at an anode current density of up to about 215 milliamps per square meter.

10. The cathodic protection system of claim 8 wherein said metal strip consists of titanium coated with an electrocatalytically active metal selected from the group consisting of platinum group metals, cobalt, tin, and nickel.

11. A process for inhibiting or preventing the corrosion of a steel reinforced concrete article by the use of a galvanic or impressed current cathodic protection system comprising a plurality of porous, metal anodes formed from a unitary, porous, metal strip comprising providing a plurality of louvers extending from a first plane of said metal strip having a largest area, said louvers having a lateral and a long dimension, and said louvers defining a second plane or both a second plane and a third plane at the lateral extremities of said louvers.

12. The process of claim 11 wherein said metal anodes comprise a sacrificial metal strip, said process comprising orienting said louvers in their long dimension at an angle of 0° to 90° to the longitudinal dimension of said metal strip and said louvers form an angle to said first plane of said metal strip at an angle greater than 0° up to 90°.

13. The process of claim 11 wherein said metal anodes comprise a valve metal strip, said process comprising orienting said louvers in their long dimension at an angle of 0° to 90° to the longitudinal dimension of said metal strip and orienting said louvers to form an angle to said first plane of said metal strip greater than 0° up to 90°.

14. The process of claim 13 wherein said metal strip comprises louvers oriented in their long dimension substantially parallel or substantially perpendicular to the longitudinal direction of said metal strip, said process comprising depositing said metal strip within a horizontal, inclined, vertical or overhead surface of said steel reinforced concrete article and operating said cathodic protection system at a current density of up to about 215 milliamps per square meter.

15. The process of claim 14 comprising selecting said metal strip from metals of the group consisting of a valve metal or alloy or mixture thereof and an electrocatalytically active metal coated valve metal or alloy or mixture thereof and each of said anodes comprises louvers forming an angle to said first plane of said valve metal strip of about 20° to about 90°.

16. The process. of claim 14 wherein said metal strip consists of an electro-catalytically active metal coated titanium or an electrocatalytically active metal coated valve metal alloy selected from the group consisting titanium-palladium, titanium-ruthenium, titanium-iron, and titanium-copper.

17. The process of claim 13 comprising orienting the louvers of each of said metal anodes in their long dimension substantially parallel to the longitudinal dimension of said strip, activating said metal anodes by exposure of a temperature of about 250° C. to about 750° C., and operating said cathodic protection system operated at a current density of up to about 550 milliamps per square meter.

18. The process of claim 17 comprising selecting said valve metal from the group consisting of titanium, tantalum, zirconium, and niobium.

19. The process of claim 17 wherein said metal strip consists of an electrocatalytically active metal coated titanium or a valve metal alloy selected from the group consisting of titanium-palladium, titanium-ruthenium, titanium-iron, and titanium-copper.

20. The process of claim 19 wherein said metal strip consists of titanium coated with an electrocatalytically active metal selected from the group consisting of platinum group metals, cobalt, tin, and nickel.

* * * * *